US010912373B2

(12) United States Patent
Graves

(10) Patent No.: US 10,912,373 B2
(45) Date of Patent: Feb. 9, 2021

(54) MAKEUP SHIELDS AND METHODS OF USE

(71) Applicant: GG Brands, LLC, Indianapolis, IN (US)

(72) Inventor: Keichun Graves, Indianapolis, IN (US)

(73) Assignee: GG BRANDS, LLC., Indianapolis, IN (US)

( * ) Notice: Subject to any disclaimer, the term of this patent is extended or adjusted under 35 U.S.C. 154(b) by 412 days.

(21) Appl. No.: 15/725,675

(22) Filed: Oct. 5, 2017

(65) Prior Publication Data

US 2018/0213918 A1 Aug. 2, 2018

Related U.S. Application Data

(60) Provisional application No. 62/453,977, filed on Feb. 2, 2017.

(51) Int. Cl.

| | |
|---|---|
| ***A45D 44/12*** | (2006.01) |
| ***A41D 13/11*** | (2006.01) |
| ***A41D 27/08*** | (2006.01) |
| ***A41D 27/12*** | (2006.01) |

(52) U.S. Cl.

CPC ..... *A45D 44/12* (2013.01); *A41D 13/1107* (2013.01); *A41D 13/1161* (2013.01); *A41D 13/1184* (2013.01); *A41D 27/08* (2013.01); *A41D 27/12* (2013.01); *A41D 2400/36* (2013.01)

(58) Field of Classification Search

CPC ..... A45D 44/12; A41D 13/1107; A41D 13/1161; A41D 13/1184; A41D 27/08; A41D 27/12; A41D 2400/36

See application file for complete search history.

(56) References Cited

U.S. PATENT DOCUMENTS

| | | | | | |
|---|---|---|---|---|---|
| 891,122 | A * | 6/1908 | Wilcox | A41D 13/11 | 2/206 |
| 960,520 | A * | 6/1910 | Dysthe | A41D 13/11 | 2/206 |
| 986,728 | A * | 3/1911 | Lee et al. | A45D 44/12 | 2/174 |
| 1,035,217 | A * | 8/1912 | McQuary, Jr. | A61F 9/029 | 2/427 |
| 1,800,051 | A * | 4/1931 | Blanco | A41D 13/1153 | 2/206 |

(Continued)

*Primary Examiner* — Richale L Quinn

(74) *Attorney, Agent, or Firm* — Workman Nydegger

(57) ABSTRACT

Makeup shields for preventing the transfer of makeup from a user to one or more objects, such as clothing are provided. For example, an embodiment of a makeup shield includes a nontransferable material and an attachment mechanism associated with the nontransferable material such that the attachment mechanism is configured to retain the nontransferable material substantially between a face of a user and one or more objects such as, for example, clothing the user is donning or doffing. The makeup shield may include a visor made of a second nontransferable material that is more sheer than the nontransferable material. Alternatively, the makeup shield includes a viewing flap and viewing window where the viewing flap is selectively opened to reveal the viewing window. An embodiment of a makeup shield may include a skirt of nontransferable material that is detachably associated with a face portion of nontransferable material.

14 Claims, 10 Drawing Sheets

*Fig. 10B*

(56) References Cited

U.S. PATENT DOCUMENTS 1,897,100 A * 2/1933 Abbott ..... A42B 1/045 2/174
2,184,240 A * 12/1939 McInnis ..... A45D 44/12 2/174
2,353,025 A * 7/1944 Gautreaux ..... A45D 44/12 2/174
2,432,767 A * 12/1947 Bella ..... A45D 44/12 2/174
2,494,406 A * 1/1950 Reitano ..... A41D 13/1161 128/206.13
2,507,447 A * 5/1950 La Joie ..... A45D 44/12 2/174
2,546,117 A * 3/1951 Whelan ..... A42B 1/046 2/174
2,987,730 A * 6/1961 Walker ..... A45D 44/12 2/174
3,138,801 A * 6/1964 Brodsky ..... A42B 1/12 2/174
3,261,027 A * 7/1966 Lambert ..... A45D 44/12 2/174
3,303,514 A * 2/1967 Wessels ..... A45D 44/12 2/174
3,505,678 A * 4/1970 Key ..... A42B 5/00 2/4
3,878,563 A * 4/1975 Pulju ..... A41D 13/1161 2/9
4,014,047 A * 3/1977 Zobel ..... D05B 33/02 128/206.19
4,133,052 A * 1/1979 Hodgman ..... A45D 44/12 2/174
4,259,748 A * 4/1981 Miller ..... A45D 44/12 2/174
4,383,539 A * 5/1983 Collins ..... A45D 33/00 132/200
4,457,027 A * 7/1984 Gladstone ..... A42B 1/046 2/174
4,583,535 A * 4/1986 Saffo ..... A62B 17/04 128/201.25
4,665,567 A * 5/1987 Dilger ..... A42B 1/046 2/174
4,698,853 A * 10/1987 Walton ..... A42B 1/046 2/174
4,886,079 A * 12/1989 Mooney ..... A45D 40/00 132/319
4,887,316 A * 12/1989 Morandini ..... A42B 1/046 2/174
4,944,312 A * 7/1990 Smith ..... A41D 13/1161 128/207.11
4,957,124 A * 9/1990 Mooney ..... A45D 40/00 132/200
5,033,115 A * 7/1991 Bowling ..... A41D 13/11 2/48
5,269,024 A * 12/1993 Wyatt ..... A41D 13/11 2/173
D343,023 S * 1/1994 Kilpatrick ..... D2/865
5,287,560 A * 2/1994 Garcia ..... A45D 8/40 132/274
5,503,167 A * 4/1996 Wilson ..... A45D 44/12 128/857
5,561,863 A * 10/1996 Carlson, II ..... A41D 13/1115 128/206.19
5,642,528 A * 7/1997 Dering ..... A45D 44/12 132/319
5,664,262 A * 9/1997 Cominsky ..... A41D 13/11 128/857
5,669,395 A * 9/1997 Thompson ..... A41D 7/006 128/846
5,694,928 A * 12/1997 Hoftman ..... A41D 13/11 128/206.19
5,697,387 A * 12/1997 Hanisco ..... A45D 8/24 132/273
5,778,455 A * 7/1998 Joseph ..... A45D 44/12 2/174
5,819,731 A * 10/1998 Dyrud ..... A41D 13/1146 128/206.27
5,865,196 A * 2/1999 Foote ..... A45D 44/12 132/285
6,351,852 B1 * 3/2002 Propp ..... A45D 19/14 132/200
6,558,221 B1 * 5/2003 Yang ..... A63H 3/365 446/100
6,622,310 B1 * 9/2003 Tsai ..... A42B 1/041 2/171
6,625,817 B2 * 9/2003 Wasmuth ..... A42C 5/04 2/174
6,820,283 B2 * 11/2004 Graneto, III ..... A45D 19/14 2/171.2
6,944,886 B1 * 9/2005 Jackson ..... A45D 44/12 2/209
6,978,785 B2 * 12/2005 Lin ..... A61F 9/04 128/849
D524,945 S * 7/2006 Pimental ..... D24/189
D546,500 S * 7/2007 Flannery ..... D2/867
7,540,039 B2 * 6/2009 Reaux ..... A41D 13/1184 128/201.15
7,578,008 B2 * 8/2009 Hunter ..... A42B 1/046 2/174
7,865,974 B1 * 1/2011 Heller ..... A61F 11/06 2/209
D743,110 S * 11/2015 Welborn ..... D29/108
9,220,629 B2 * 12/2015 Koike ..... A61F 5/56
D750,843 S * 3/2016 Welborn ..... D29/108
9,585,430 B1 * 3/2017 Singh ..... A42B 1/04
9,643,033 B2 * 5/2017 Yadav ..... A62B 17/006
10,010,156 B2 * 7/2018 Yakis ..... A61N 5/0614
2003/0028946 A1 * 2/2003 Zegarelli ..... A41D 13/11 2/9
2003/0088902 A1 * 5/2003 Levy ..... A41D 13/04 2/50
2014/0053853 A1 * 2/2014 Hearst ..... A41D 13/1107 128/863
2014/0109918 A1 * 4/2014 Nabai ..... A41D 13/1184 128/858
2014/0224261 A1 * 8/2014 Tsuei ..... A62B 23/025 128/863
2015/0203995 A1 * 7/2015 Adams ..... D03D 1/0035 2/455
2017/0258151 A1 * 9/2017 Roberts ..... A41D 13/1161
2019/0125011 A1 * 5/2019 Eisenbrey ..... A41D 13/1115

* cited by examiner

MAKEUP SHIELDS AND METHODS OF USE

CROSS-REFERENCE TO RELATED APPLICATIONS

This application claims priority to and the benefit of U.S. Provisional Patent Application Ser. No. 62/453,977, filed Feb. 2, 2017 and titled "MAKEUP SHIELDS AND METHODS OF USE," the disclosure of which is incorporated herein by this reference in its entirety.

BACKGROUND

Technical Field

This disclosure generally relates to protective devices. More specifically, the present disclosure relates to a protective shield for the head and/or torso that prevents the soiling of clothes by cosmetics and/or preserves a user's applied makeup while donning or doffing clothing.

Related Technology

Makeup has been used throughout the ages and all over the world for various purposes. It has been applied ritualistically by warriors of various tribal societies before battle as a means of creating unity and encouragement within the warriors and striking fear into their opponents on the battlefield. Makeup has also been used by religious sects to indicate symbols of faith and belonging. In addition to the historical and/or religious purposes of makeup and other cosmetics, many people within our modern society have their own individualistic reasons to use makeup. For example, some people use makeup to beautify their appearance. Others use it as a form of artistic expression. Still others use makeup to cover blemishes, to increase confidence, or simply because they enjoy doing so.

Regardless of the motivation for using makeup, applying it is an investment in time—an individual's most precious resource. It is desirable, then, to preserve the appearance of makeup once it has been applied to a user's body. However, there are many circumstances and scenarios encountered by people on a daily basis that may cause the makeup to smear, run, or otherwise be impacted in an undesirable way. This not only has a negative impact on the individual whose makeup is ruined, but it has the potential to soil objects that it contacts. Makeup commonly includes oils, waxes, pigments, or other colorants that are difficult, if not impossible, to clean. Yet, despite the widespread use of makeup in many modern day societies and the potential downside of inadvertently displacing applied makeup onto an object and soiling it, there is a surprising dearth of devices that act to preserve an individual's makeup and/or protect other articles from coming into contact with it.

Accordingly, there are a number of disadvantages in the art of makeup protectors that can be addressed.

BRIEF SUMMARY

Implementations of the present disclosure solve one or more of the foregoing or other problems in the art with systems and apparatuses for preventing the transfer of makeup from a user to other objects, such as clothing. In particular, one or more implementations can include a makeup shield for preventing the transfer of makeup; the makeup shield includes a nontransferable material and an attachment mechanism associated with the nontransferable material that is configured to retain the nontransferable material substantially between a face of a user and one or more objects.

Another example of a makeup shield provided by the present disclosure includes a makeup shield for preventing the transfer of makeup. The makeup shield includes a nontransferable material and an elongate elastic band associated with an edge of the nontransferable material where the nontransferable material defines an enclosure and the elongate elastic band defines an elongate opening of the enclosure. The elongate opening is configured to associate with and be retained on a face of a user. The makeup shield also includes a skirt comprising the nontransferable material that is detachably connected to at least a portion of the elongate elastic band. The skirt is configured to associate with one or more of at least a portion of a neck of a user, a chest of a user, a back of a user, or combinations thereof.

Yet another example of a makeup shield provided by the present disclosure includes a makeup shield for preventing the transfer of makeup to clothing when said clothing is donned or doffed by a user. The makeup shield includes a nontransferable material that is a translucent, a breathable, and a lightweight polyester fabric that acts as a barrier to prevent the transfer of makeup from at least a portion of a face of the user to one or more objects on an opposing side from the face of the user. The makeup shield also includes a circularized, elongate elastic band associated with an edge of the nontransferable material, wherein the nontransferable material defines an enclosure and the circularized, elongate elastic band defines an elongate opening of the enclosure. The circularized, elongate elastic band is stretchable from an unstretched state to a stretched state such that the elongate opening is larger in diameter in the stretched state than in the unstretched state, and in the stretched state, the elongate opening is sized to at least fit the face of the user. The makeup shield additionally includes a visor positioned on the makeup shield at an eye position of the user, the visor comprising a second nontransferable material that is more translucent than the nontransferable material.

Accordingly, makeup shields for preventing the transfer of makeup are disclosed. This summary is provided to introduce a selection of concepts in a simplified form that are further described below in the detailed description. This summary is not intended to identify key features or essential features of the claimed subject matter, nor is it intended to be used as an indication of the scope of the claimed subject matter.

Additional features and advantages of the disclosure will be set forth in the description that follows, and in part will be obvious from the description, or may be learned by the practice of the disclosure. The features and advantages of the disclosure may be realized and obtained by means of the instruments and combinations particularly pointed out in the appended claims. These and other features of the present disclosure will become more fully apparent from the following description and appended claims, or may be learned by the practice of the disclosure as set forth hereinafter.

BRIEF DESCRIPTION OF THE DRAWINGS

In order to describe the manner in which the above recited and other advantages and features of the disclosure can be obtained, a more particular description of the disclosure briefly described above will be rendered by reference to specific embodiments thereof, which are illustrated in the appended drawings. It is appreciated that these drawings depict only typical embodiments of the disclosure and are not therefore to be considered to be limiting of its scope. The disclosure will be described and explained with additional specificity and detail through the use of the accompanying drawings in which.

DETAILED DESCRIPTION

Figure 1A:
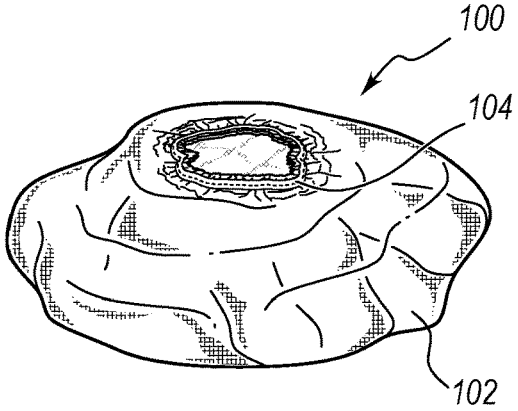
FIG. 1A illustrates an exemplary makeup shield in a compact form according to an embodiment of the invention.

Before describing various embodiments of the present disclosure in detail, it is to be understood that this disclosure is not limited to the parameters of the particularly exemplified systems, methods, apparatus, products, processes, and/or kits, which may, of course, vary. Thus, while certain embodiments of the present disclosure will be described in detail, with reference to specific configurations, parameters, components, elements, etc., the descriptions are illustrative and are not to be construed as limiting the scope of the claimed invention. In addition, the terminology used herein is for the purpose of describing the embodiments, and is not necessarily intended to limit the scope of the claimed invention.

Overview of Cosmetic Protection Devices

As briefly described above, there are myriad reasons to wear makeup and invest valuable time applying it, whether on a daily basis or for a special occasion. It can provide many benefits to an individual at once and different benefits at different times. For example, makeup can help a pubescent teenager feel less insecure about facial blemishes by occluding them from view, masking their presence, or drawing a viewer's attention towards another facial feature. At a different time, makeup may be used by that same pubescent teenager to express an artistic point of view or as a means for engendering confidence and empowerment.

Many individuals prefer that makeup creates a natural appearance and/or enhances selected features. This typically means precise and intentional application of the makeup, which is often an investment of both time and focused attention. As a result, it is often desirable to preserve the finalized appearance of makeup for an intended period of time or longer, making it important to protect the makeup from unintentionally smearing, running, or transferring to other objects.

Aside from the aesthetic damage caused by an unintentional smearing or transferring of makeup to another object, that object may be irreversibly stained by the makeup. Makeup commonly includes oils, waxes, pigments, or other colorants, and similar to the wide variety of people who use makeup, makeup itself comes in a wide variety of shades and colors—from the traditional black mascara to the electric blue eye shadow or iconic red lipstick. Alone and in combination, the ingredients and bold colors common to many forms of makeup may be visually appealing when artfully applied but can unfortunately cause irreversible staining or soiling of objects that it comes into contact with, particularly clothing.

This can be problematic when donning and doffing clothing. Many women prefer to apply makeup before completely dressing, and this beneficially acts to prevent makeup from spilling on and soiling their clothes while they apply it. However, because makeup was applied before being fully clothed, care needs to be taken to avoid contacting the freshly applied makeup while donning clothes. Pulling a blouse, shirt, dress, or other garment over one's head risks disrupting the individual's makeup and further risks transferring the makeup to the clothing. This is not just a problem in the home or with the daily routine of applying makeup and donning clothing; it also has commercial implications.

It is common for women to try on clothing before purchasing them, and women's clothing stores are constantly faced with damage to the clothing caused by makeup being transferred thereto by prospective buyers as they try on the clothing. When makeup is transferred from the prospective buyer to the clothing, not only does the prospective buyer ruin their makeup, the retailer is left with a garment that is likely irreversibly stained and unmarketable.

Embodiments of the present invention provide makeup shields that prevent transfer of makeup to clothing while a user dons and doffs clothes and, in some embodiments, may additionally preserve the aesthetic appearance of applied makeup by not smearing or smudging the makeup. In one embodiment, the makeup shield includes nontransferable material attached to a circularized elastic band, the nontransferable material enclosing a space configured to house a substantial portion of the individual's face while they put on or take off clothing. The nontransferable material creates a barrier between the user's face—and any associated makeup—and the clothing to prevent makeup from transferring from the user to the clothing.

It should be appreciated that although some of the illustrated or recited embodiments disclosed herein provide a circularized or elongate nontransferable material and/or attachment mechanism, any shape of nontransferable material and/or attachment mechanism is considered within the scope of this disclosure. For example, the nontransferable material may take on a polygonal shape such as a triangular shape (e.g., with a point directed upwards towards a crown of the user's head, downwards towards a user's chest, or any other direction and/or configuration), a quadrilateral, a pentagon, a hexagon, a heptagon, an octagon, or other polygonal shape.

In some embodiments, the makeup shield is disposable and may be compressed or compacted into a box or other container and provided in dressing rooms of clothing retailers. A prospective buyer who wishes to try on clothing yet maintain the aesthetic appearance of their makeup or prevent the inadvertent transfer of their makeup to their clothing or the retailer's merchandise may acquire and don a makeup shield before changing their clothes. The makeup shield prevents transfer of makeup to the clothes and may additionally protect the user's makeup from smudging or smearing. This provides benefits to both the retailer and a perspective buyer. Also, by being disposable, prospective buyers are more likely use to what is perceived as a new, clean makeup shield and dispose of them afterwards as opposed to donning a previously used or communal makeup shield found in the dressing room.

Though attention has been previously focused on a perspective buyer using the makeup shields disclosed herein while trying on clothes in a retail environment, it should be appreciated that an individual may equally use a makeup shield in their home to protect their personal clothing and/or makeup. A personal use makeup shield may be disposable, as described above, or it may be reusable. In some embodiments, a reusable makeup shield is machine washable, thereby allowing it to be cleaned in the event it is soiled by cosmetics or other means.

Various additional features and embodiments of makeup shields described herein are provided below and may make reference to the accompanying figures, when necessary.

Exemplary Makeup Shields, Retaining Elements, and Methods of Application

Embodiments of the present disclosure enable makeup shields that protect from the inadvertent contact of makeup and other objects, particularly clothing, and methods of applying the same.

Figure 1B:
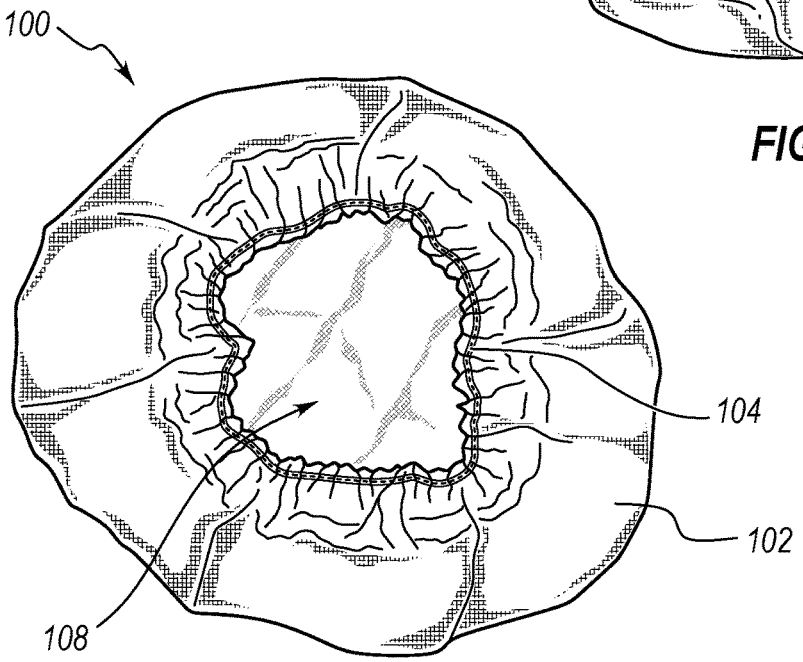
FIG. 1B illustrates an unpacked form of the exemplary makeup shield of FIG. 1A.
Figure 1C:
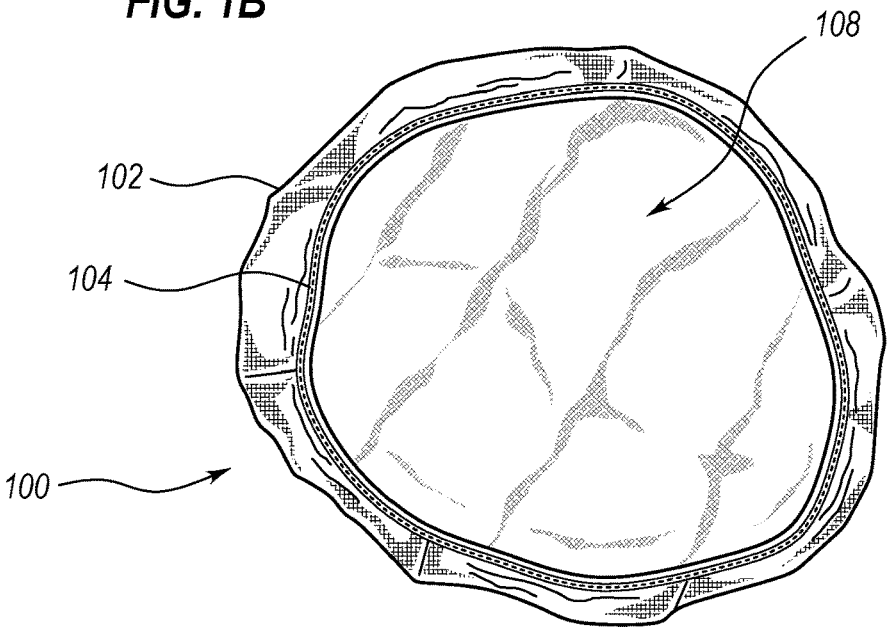
FIG. 1C illustrates an expanded form of the exemplary makeup shield of FIG. 1A.

Referring now to FIGS. 1A-1C, illustrated in FIG. 1A is an embodiment of a compacted and/or folded up makeup shield 100. As illustrated by this figure, and when compared to the unpacked and/or expanded forms depicted in FIGS. 1B and 1C, respectively, it can be appreciated that in some embodiments, a makeup shield 100 can be compressed and/or compacted into a relatively small volume of space. The small footprint of a single makeup shield makes it possible and advantageous to package a plurality of makeup shields into a container. For example, a container roughly the size of a shoebox or the size of a box containing disposable gloves (e.g., about 8.5 in.×5 in.×3 in.), as commonly seen in physicians' offices and hospitals, may contain as many as a 1,000 makeup shields. In some embodiments, a similarly sized container includes as many as 750 makeup shields, as many as 500 makeup shields, as many as 400 makeup shields, as many as 300 makeup shields, as many as 200 makeup shields, as many as 100 makeup shields, as many as 75 makeup shields, as many as 50 makeup shields, or as many as 25 makeup shields. It should be appreciated that the size of the container may be directly proportional to the total number of makeup shields that may be stored therein, and the container may be of any size or shape.

As depicted in FIG. 1A, and illustrated through FIGS. 1B and 1C, an exemplary makeup shield 100 includes nontransferable material 102 associated with an elastic band 104. The nontransferable material 102 defines an enclosure that can be accessed through an arcuate opening 108 defined by the elastic band 104, and the elastic band 104 can be stretched and/or extended to differentially size the opening 108 in the makeup shield 100 (as depicted in FIGS. 1B and 1C). In one embodiment, elastic band 104 is circularized to form an oblong shape, similar in shape to the profile of a human face.

Figure 2A:
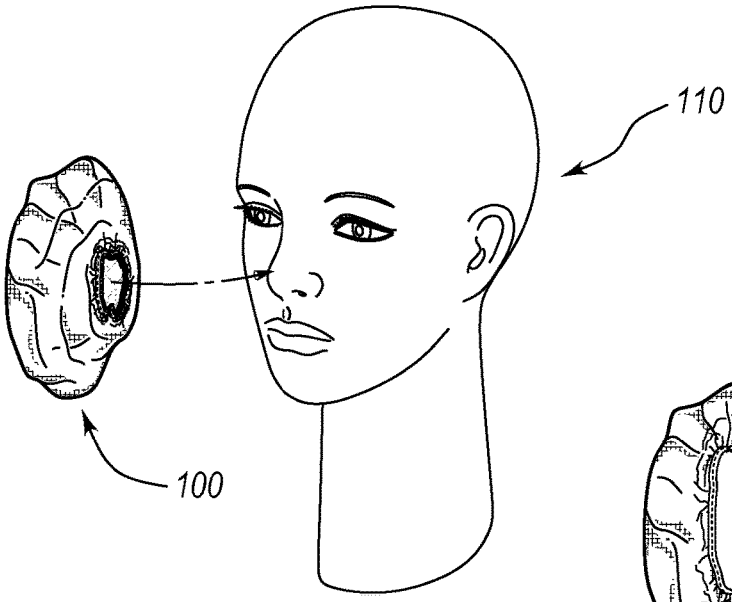
FIG. 2A illustrates orienting an exemplary makeup shield to a user in preparation for applying the makeup shield.
Figure 2B:
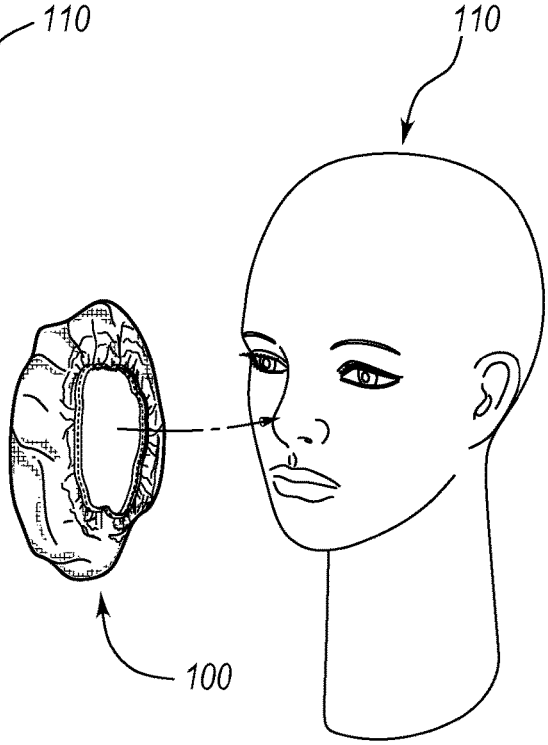
FIG. 2B illustrates expanding the exemplary makeup shield of FIG. 2A as an act of applying the makeup shield to a user.
Figure 2C:
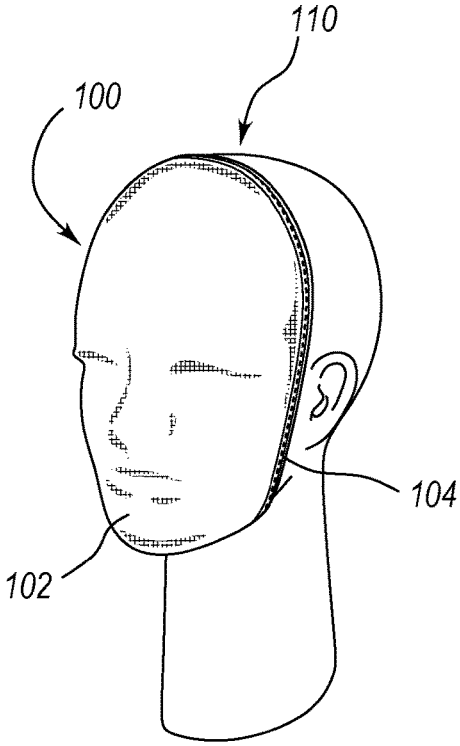
FIG. 2C illustrates a side perspective view of the exemplary makeup shield of FIG. 2A as applied to a user.
Figure 2D:
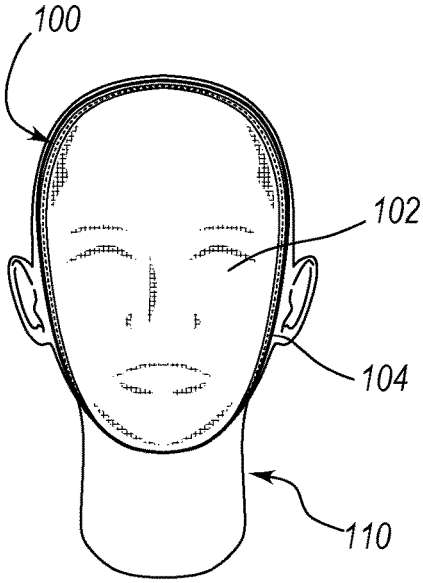
FIG. 2D illustrates a front portrait view of the exemplary makeup shield of FIG. 2A as applied to a user.

Stretching and/or expanding the elastic band 104 allows a user to apply the makeup shield 100 to a user 110. As illustrated in FIGS. 2A-2D, the makeup shield 100 is worn about a user's face. For example, FIG. 2A illustrates an unpacked makeup shield 100 with the elastic band 104 in an unstretched or at least partially unstretched state. In one embodiment, and as illustrated in FIGS. 2B and 2C, the elastic band 104 is stretched over the crown of a user's head and beneath the user's chin, framing their face within the enclosure defined by the nontransferable material.

The elastic band 104 may be of any length/circumference and may depend on the size of the opening 108 desired when the elastic band 104 is extended and/or the tightness by which the elastic band 104 constricts the head, the chin, and/or the face when disposed thereon to hold the makeup shield 100 in position about the face. It can be appreciated that the longer the elastic band is, the larger the opening may be when the elastic band is fully extended, and conversely, the shorter the elastic band is, the smaller the opening may become when the elastic band is fully extended. In one embodiment, the elastic band is between about 10-30 inches in length, about 10-25 inches in length, about 10-20 inches in length, about 12-24 inches in length, about 15-25 inches in length, or about 19-23 inches in length. In one embodiment, the elastic band is about 21 inches in length. The length of the elastic band may be shortened or lengthened as desired or customized to fit an individual to their preference.

In one embodiment, the nontransferable material is associated with other attachment mechanisms, such as a measure of substantially circularized string, instead of a circularized, elongate elastic band. The string may be tied to secure the makeup shield to the user and thereby serve a substantially similar function as the circularized, elongate elastic band.

It should be appreciated that any additional, or alternative, attachment mechanism may be associated with the nontransferable material and serve the same or substantially similar function of attaching the makeup shield to a user. For example, the attachment mechanism may be a hook and loop fastening system, a button, a snap, and/or a clip that when disassociated allow the user to freely put on or take off the makeup shield, and when associated, the makeup shield is attached to the user.

In some embodiments, the nontransferable material is sufficiently sized such that when the user's face is within the space enclosed by the nontransferable material, the nontransferable material is not substantially pressing against the user's face. For example, there may be additional space provided between one or more of the user's forehead, the user's nose, the user's cheeks, user's mouth, a least a portion of the user's chin, or combinations thereof. Additionally, or alternatively, the makeup shield may be positioned about the user's face to cover different portions thereof. For example, the makeup shield may be placed towards the front of the user's face, covering less area between the nose and the ear on one or more sides of the user's face but still maintaining substantial coverage of the front side of user's face. Alternatively, the makeup shield may be placed about the user's face such that a substantial portion of the user's cheeks, jaw, forehead, nose, and eyes are enclosed by the space defined by the nontransferable material. It should be appreciated that a user may position the makeup shield at any position and/or coverage of their face based on comfort, the area(s) on the user's face where makeup is applied, or other considerations.

While it is envisioned within the scope of this disclosure that nontransferable material can include one or more of a non-woven or woven textile derived from animal (e.g., wool, silk, animal skin/fur, etc.), plant (e.g., hemp, cotton, flax, etc.), synthetic material (e.g., nylon, polyester, acrylic, polyethylene, etc.), or combinations thereof and may be selected from any color, pattern, and/or organization, every embodiment described herein that includes nontransferable material must include at least those materials (or a combination of materials) that do not allow makeup to transfer through the selected material (i.e., from the surface facing the user to an exterior surface). In some embodiments, it is preferred that the nontransferable material is chosen from those materials that are lightweight, transparent/translucent, and/or breathable. In some embodiments, the nontransferable material includes one or more materials that conform to a user's ideology and/or lifestyle. For example, the nontransferable material may include cruelty-free fabrics that comport with a Vegan lifestyle or are otherwise strictly plant-based fabrics and/or materials.

As used herein, the term "lightweight" includes materials made using thin thread and/or a low density knit/weave. In some embodiments, lightweight materials are at least somewhat translucent as a result of the low-density knit/weave and/or thin thread used in the material. Additionally, or alternatively, "breathable" materials, as used herein, may also be lightweight. A material is breathable if it allows a user to breathe naturally—without increased labor or with a minor increase in labor—through the material. An unbreathable material is a material that substantially restricts the free flow of gases, such as, for example, cellophane or other laminated plastics. A material is considered transparent/translucent if at least 50% of the light can pass through the material. The transparency of a material, in some embodiments, may be measured as a matter of sheerness of the fabric, which may be measured in denier—for example, less than 10 denier results in a very sheer and almost transparent material, about 11-20 denier results in a fabric that is translucent similar to that of a standard sheer nylon stocking, about 21-40 denier results in a material that is moderately translucent and/or semi opaque, about 41-69 denier results in a material that is partially translucent and/or moderately opaque, and about 70-99 denier results in a material that is substantially non-translucent and/or substantially opaque, becoming opaque at 100 denier. In some embodiments, the transparency of the material is similarly reflective of the breathability of the material such that opaque materials have low breathability, semi-opaque materials have moderate breathability (i.e., minor labored breathing), translucent materials have good breathability (i.e., little to no labored breathing), and almost transparent materials have great breathability (i.e., no labored breathing). Nontransferable materials disclosed herein may be any combination of lightweight, breathable, and transparent/translucent insofar as the resultant material retains the quality of nontransferability, as described herein.

An exemplary composition of material that is nontransferable, lightweight, transparent/translucent, and breathable includes 100% polyester. It should be appreciated that in some embodiments the nontransferable material includes polyester combined with one or more other non-woven or woven textiles to increase one or more desirable qualities, such as comfort, structure, durability, and/or transparency/translucency. Materials similar to polyester may be combined therewith and include, for example, rayon, spandex, and/or nylon. In some embodiments, the nontransferable material may be present at specific locations on the makeup shield while a second material that lacks one or more qualities of the nontransferable material (e.g., lightweight, translucent/transparent, breathable, and/or transferability of makeup). The specific locations may include locations where makeup is more likely to transfer or common contact points between the user's face and clothing when a user dons or doffs said clothing. For example, specific locations where makeup is more likely to transfer include the cheek, particularly beneath the eyes, the forehead, the nose, the lips, and/or the eyes/eyelashes.

In a preferred embodiment, the makeup shield comprises 100% polyester and is transparent/translucent, breathable, lightweight, and nontransferable. An additional preferred embodiment includes a 90% polyester, 10% spandex mix, which maintains the beneficial qualities of the 100% polyester. In some implementations, however, the 90% polyester, 10% spandex mix is more prone to disturb makeup on the user's face than the 100% polyester material. In an alternative embodiment, the nontransferable material comprises a composition of 82% nylon and 18% spandex, which while maintaining nontransferability, may be considered too heavy for optimal comfort and is not as breathable as 100% polyester.

In some embodiments, the makeup shield additionally acts as a sanitary face shield. For example, the makeup shields disclosed herein may prevent pathogen transmission from the user to objects within the user's surrounding area. This may be done by preventing airborne pathogens or droplets of pathogen-laden saliva from issuing from the user's mouth or nose to surrounding fomites or individuals when the user sneezes, coughs, or exhales. It may additionally act to prevent the user from contaminating their hands (or other body parts) or self-inoculating by preventing the user from directly touching their eyes, nose, ears, and/or mouth (or the mucus membranes associated with any of the foregoing). This can beneficially reduce the amount of disease transmission and self-inoculation.

In some embodiments, a sanitary face shield prevents up to about 90% of microbial pathogen transmission from the nose, eyes, and/or mouth, up to about 95% of microbial pathogen transmission from the nose, eyes, and/or mouth, up to about 97% of microbial pathogen transmission from the nose, eyes, and/or mouth, up to about 98% of microbial pathogen transmission from the nose, eyes, and/or mouth, up to about 99% of microbial pathogen transmission from the nose, eyes, and/or mouth, or up to substantially all microbial pathogen transmission from the nose, eyes, and/or mouth. In some embodiments, makeup shields made with 100% polyester prevent sufficient microbial transmission to act as sanitary face shield.

Some materials fail to exhibit nontransferable characteristics. For example, 100% nylon soft mesh fails to act as a transferability barrier, allowing makeup to transfer through the material to an object on the opposite side. Thus, this material and similar materials lacking nontransferable characteristics should be avoided as a predominant material of makeup shields according to embodiments of the present disclosure.

Referring now to FIGS. 3-6, illustrated are various embodiments of makeup shields 100 and various attachment mechanisms associated therewith. The term "attachment mechanism," as used herein, includes any device in one or more pieces that may be used to "attach" a makeup shield to a user or "attach" one or more components of a makeup shield to a user. The term "attach" and/or "attachment" may refer to its common dictionary definition where appropriate, but it may contextually refer to particular acts of connecting, associating, affixing, fastening, sticking, or any combination of the foregoing that cause an object to be fixedly or selectively proximate another object. In some embodiments, an attachment mechanism may be an integral part of a makeup shield, whereas in other embodiments, an attachment mechanism may be separate. An attachment mechanism is to be understood to have any number of movable and/or fixed parts, any of which may singularly or in combination with one or more components interact to facilitate attachment. As a non-limiting example, an attachment mechanism includes an elastic band (as described above), a flexible strap, hook and loop fasteners, ties, buttons, and/or clips.

Figure 3:
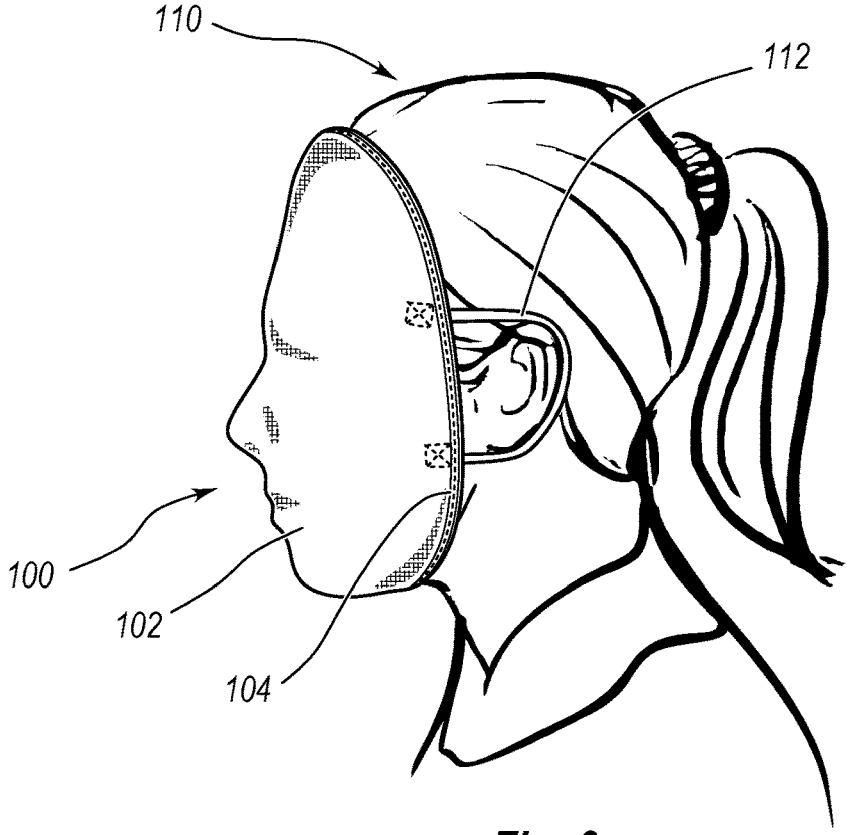
FIG. 3 illustrates an embodiment of a makeup shield that includes ear straps.

As illustrated in FIG. 3, the makeup shield 100 includes nontransferable material 102 associated with an attachment mechanism—a circularized, elongate elastic band 104. In some embodiments, the circularized, elongate elastic band 104 secures the makeup shield 100 to the user 110 such that the makeup shield 100 remains associated with the user 110 despite disturbances or minor forces applied in a plane substantially parallel to the user's face (e.g., a downward tug of a shirt being donned or an upward tug of a shirt being doffed). The makeup shield 100 of FIG. 3 additionally includes a securing strap 112, which acts to retain the makeup shield 100 on the user 110 despite disturbances or minor forces applied transverse to a plane that is parallel to the user's face (e.g., forces that pull the makeup shield away from the user's face).

As depicted in FIG. 3, the securing strap 112 is selectively placed behind a user's ear. The securing strap 112 is illustrated as a predefined loop of elastic material configured to stretch and secure about the user's ear. In one embodiment, the securing strap is a predefined loop of non-elastic material (e.g., cloth, or the nontransferable material(s) of the makeup shield) configured to be secured about the ear. In one embodiment, securing straps are disposed on opposing sides of the makeup shield, and each strap may be selectively secured to an ear on the same side as the securing strap. In one embodiment, the securing strap includes two separable and adjustable straps secured together by a button, hook and loop fasteners, snaps, and/or clips. The securing strap may be fixedly or detachably connected to the elastic band (or other attachment mechanism associated with the nontransferable material) and/or the nontransferable material, itself.

It should be appreciated that in some embodiments the nontransferable material is not pressed against the user's face and/or body even with the securing strap placed around the user's ear such that the nontransferable material is not in contact with the user's makeup, is not in contact with at least a substantial portion of the user's makeup, or is at least not in contact with a portion of the user's makeup.

Figure 4:
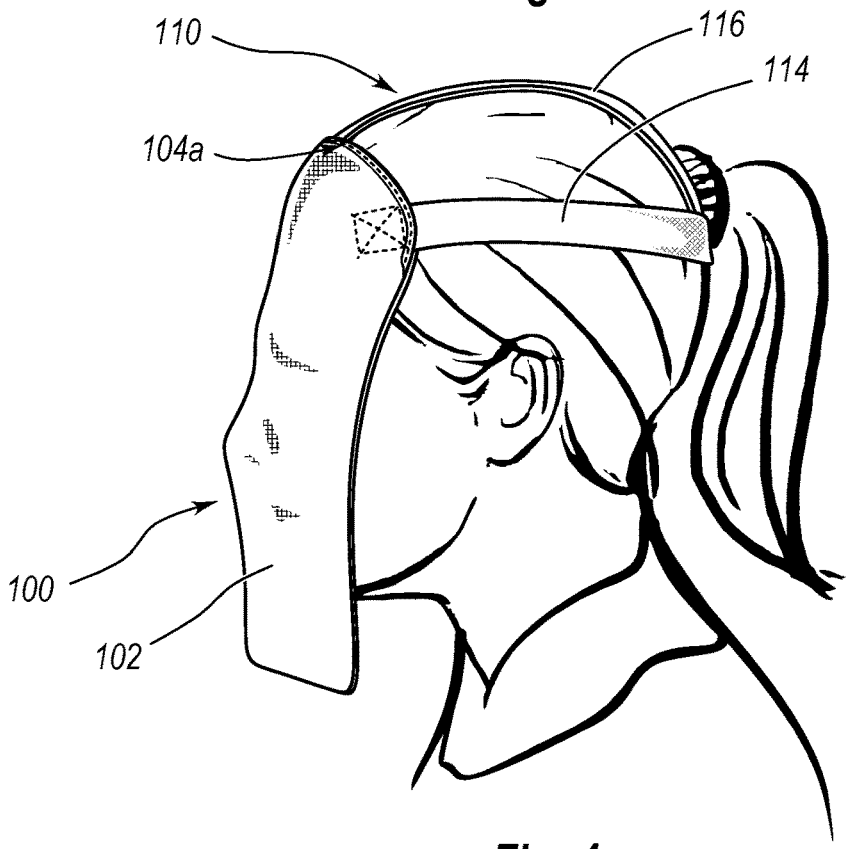
FIG. 4 illustrates an embodiment of a makeup shield having a head strap.

Referring now to FIG. 4, illustrated is a makeup shield 100 having a plurality of head straps 114, 116 associated with the least one edge of the nontransferable material 102. The nontransferable material 102 is secured to the user 110 by the plurality of head straps 114, 116, which as depicted in FIG. 4 may include a circumferential head strap 114 and a dome strap 116. The circumferential head strap 114 is placed around the user's head and acts to position the top most edge of the nontransferable material 102 on the user's face. The dome strap 116 is associated with the nontransferable material 102 and/or the circumferential head strap 114 at a first end. The dome strap 116 additionally connects with the circumferential head strap 114 at an end opposite to the first end such that when a user 110 dons the makeup shield 100 illustrated in FIG. 4, the dome strap 116 spans a top portion of the user's head. In some embodiments, the circumferential head strap 114 and/or the dome strap 116 are made of elastic material that stretches over and/or around the user's head. In other embodiments, the straps 114, 116 are adjustable.

Also illustrated in FIG. 4, the nontransferable material 102 is connected to the plurality of straps 114, 116 at a single edge portion, allowing the nontransferable material 102 to drape over the user's face. As the user 100 dons clothing, the nontransferable material 102 is secured in place by the plurality of head straps 114, 116 and acts as a barrier between the user's face and the clothing. In some embodiments, the dome strap prevents the makeup shield from sliding down the user's face while the user dons clothing. For example, the user may don a top with a constrictive neck that even when stretched applies a certain amount of pressure on one or more sides of the user's head as it is drawn thereover. In the absence of the dome strap, the constrictive pressure may encourage the circumferential head strap to slide down the user's face. The dome strap, therefore, may act to retain the nontransferable material (and the associated circumferential head strap) in a desired position.

In some embodiments, the nontransferable material drapes from the edge associated with the plurality of straps and extends to the user's chin. Some individuals apply makeup not only to their face but onto their neck and/or chest as well. In some embodiments, therefore, the nontransferable material extends past the user's chin and to at least a top portion of the user's chest below the neck. In yet other embodiments, the nontransferable material extends at least partially down the user's chest. The length of the nontransferable material may be selected based on what portions of the user's face and/or body is to be protected and/or have makeup applied thereto.

Some individuals apply makeup to their upper back and/or the back of their neck. Accordingly, in some embodiments, a second portion of nontransferable material is provided on an opposite side of the plurality of straps, corresponding to the back side of the user and extends to a point at or below a user's neck or to a position at least partially down the user's back.

Figure 5A:
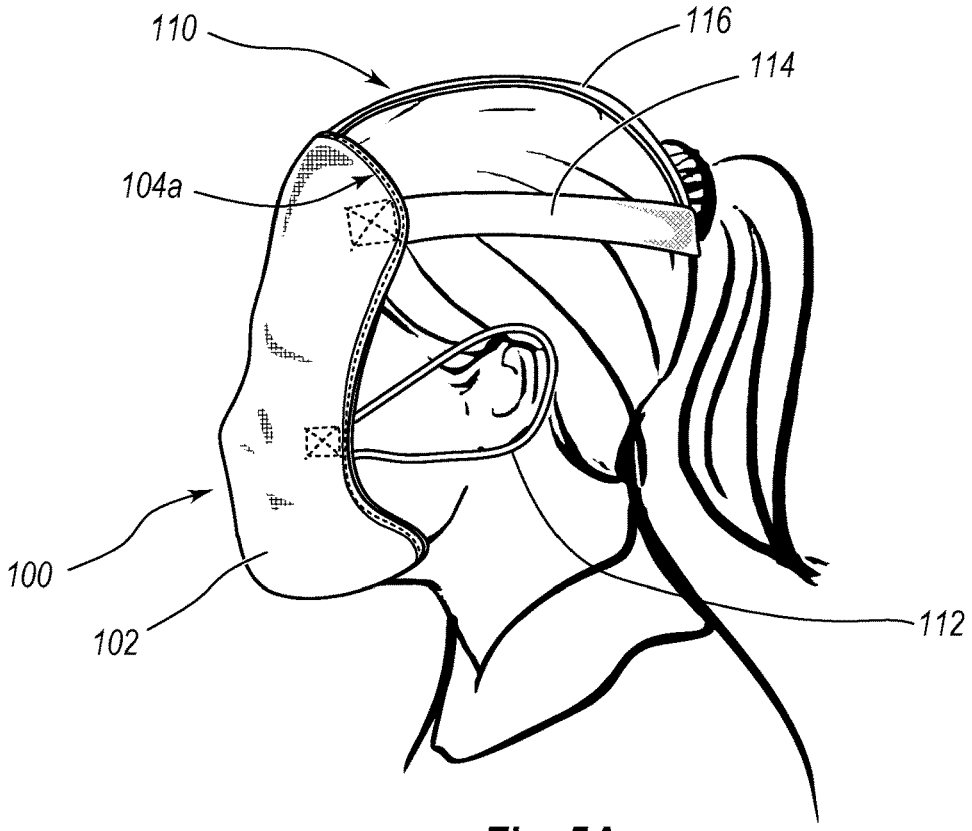
FIG. 5A illustrates an embodiment of a makeup shield that includes an ear strap and a head strap.

In some embodiments, the makeup shields described above with respect to FIG. 4 may be additionally associated with one or more additional attachment mechanisms, such as the securing strap 112 illustrated in FIG. 5A. A securing strap 112, as depicted in FIG. 5A, may be associated with a portion of the nontransferable material 102 at or near the user's chin and secured to the user by being looped around the user's ear, regardless of the total length of the nontransferable material 102. For example, the nontransferable material may extend to the user's chest, and the securing strap is positioned at a point below the circumferential head strap and above its endpoint on the user's chest. In one embodiment, the securing strap is positioned at the bottom of the nontransferable material, regardless of its length. Additionally, or alternatively, the securing strap may be a string that is tied behind the user's head and/or neck.

Figure 5B:
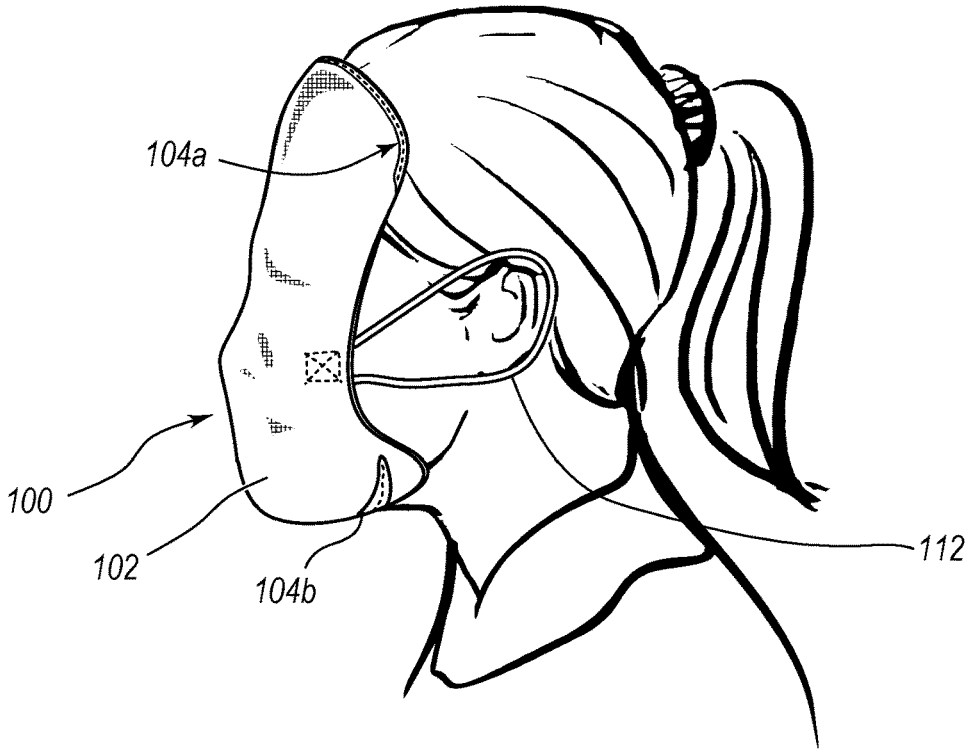
FIG. 5B illustrates an embodiment of a makeup shield that includes an ear strap, a crown band, and a chin band.

It should be appreciated that the makeup shields 100 depicted in FIGS. 4 and 5, in some embodiments, may include a circumferential head strap 114 but lack a dome strap 116. Additionally, or alternatively, as shown in FIG. 5B, a makeup shield 100 can include securing straps 112 configured to be looped around the user's ear and may additionally include a crown band 104*a* and/or a chin band 104*b* for securing the makeup shield 100 to a user's face. In some embodiments, one or more of the crown band 104*a* or the chin band 104*b* are positioned at an edge of the nontransferable material 102 and can be made of or include an elastic material.

As illustrated, for example, in FIG. 5B, the crown band 104*a* is positioned about a crest or crown region of a user's head, which may in some embodiments act to secure the makeup shield 100 to the user's head—at least at the crown thereof. As further shown in FIG. 5B, the chin band 104*b* is positioned about a chin region of a user, which may in some embodiments act to secure the makeup shield 100 to the user's head—at least at a chin portion thereof. That is to say, in some embodiments, a makeup shield 100 includes a crown band 104*a*, a chin band 104*b*, and a securing strap 112 that can individually or collectively secure a makeup shield 100 to a user's face. The crown band 104*a* can individually or collectively with chin band 104*b* constrict the makeup shield 100 to the contours of the user's crown and/or chin to prevent lateral movements of the makeup shield 100 relative the user's face. The securing strap 112 can additionally secure the makeup shield 100 to a user's face by preventing the makeup shield from being pulled away from the user's face in a direction normal to and away from a plane substantially parallel thereto.

It should be appreciated that the crown band 104*a* and chin band 104*b* depicted in FIG. 5B can be made out of any elastic material or a lightweight thin piece of deformable metal that can be bent to the contours of a user's face.

Figure 6A:
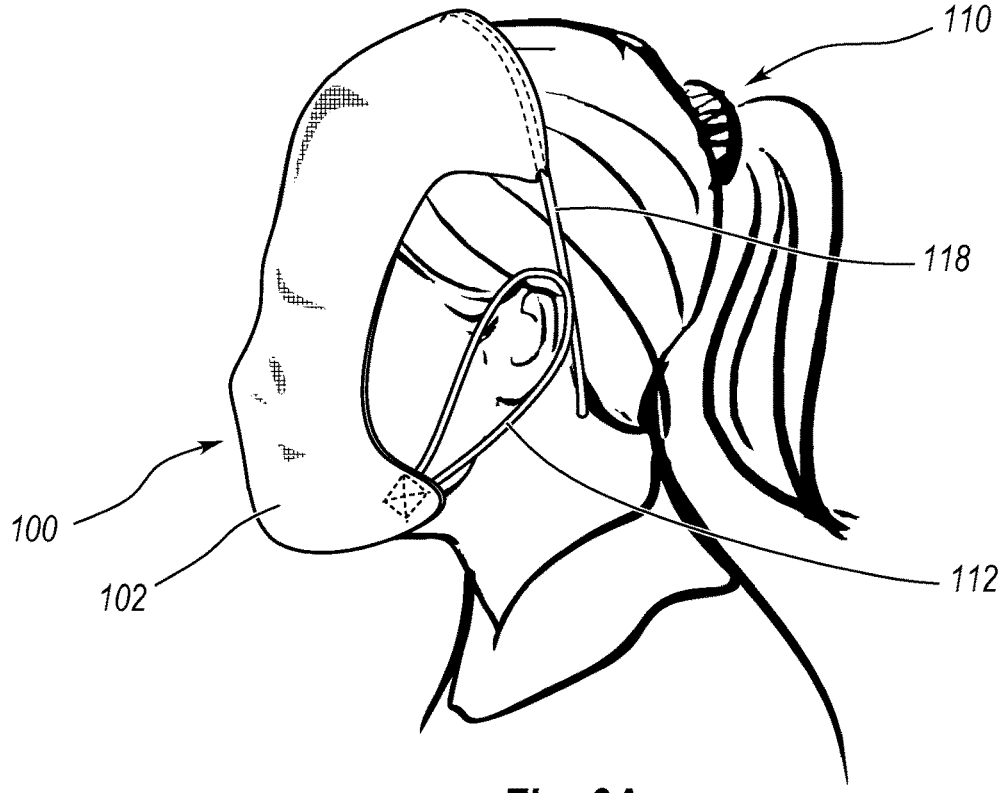
FIG. 6A illustrates an embodiment of a makeup shield associated with a head band and an ear strap.
Figure 6B:
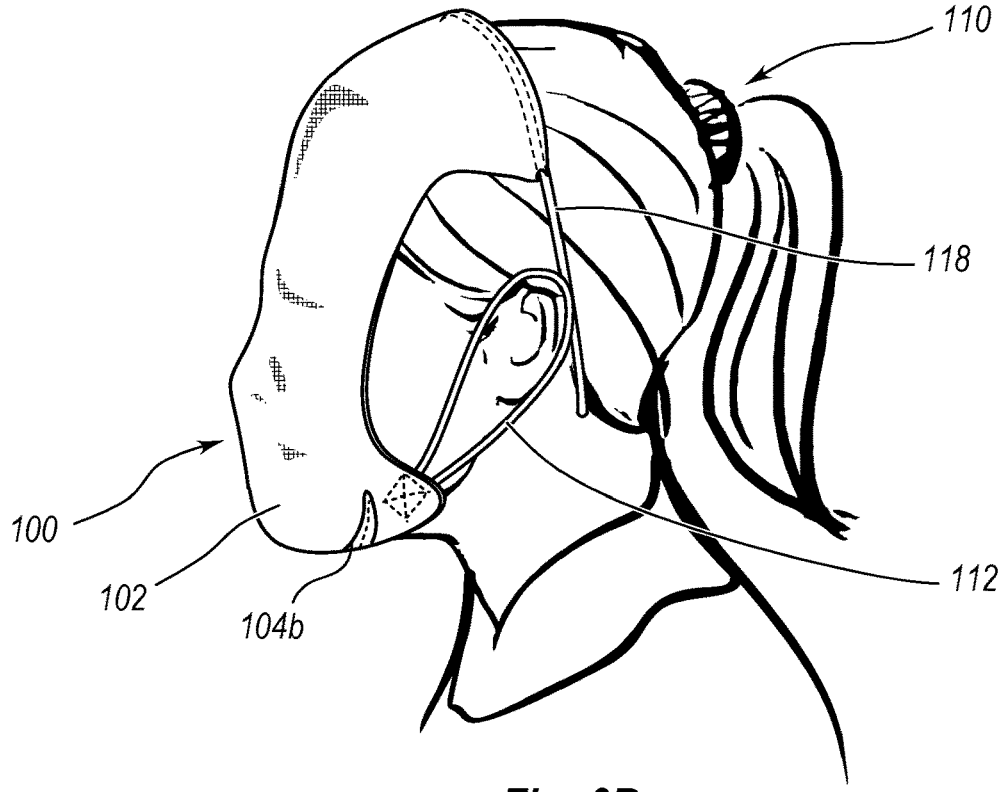
FIG. 6B illustrates an embodiment of a makeup shield associated with a head band, an ear strap, and a chin band.

Referring now to FIG. 6A, at least one edge of the nontransferable material 102 is associated with a headband 118. The nontransferable material 102 drapes over the user's face, and a securing strap 112 additionally associates the nontransferable material 102 of the makeup shield 100 with the user 110 in any manner or form described above. In one embodiment, the headband is U-shaped and made of a semi-rigid material that flexes so that when the headband is placed over the crown of a user's head, it flexes to conform thereto. In one embodiment, and as depicted in FIG. 6B, a top portion of the nontransferable material is associated with the headband and a bottom portion of the nontransferable material is associated with an elastic band (e.g., illustrated as chin band 104*b*). The elastic band may be stretched over the user's chin to secure the bottom portion of the nontransferable material to the user's face, similar to the circularized, elongate elastic band 104 of FIGS. 1-3 and/or the crown band 104*a* and chin band 104*b* of FIG. 5B.

Additional Structural and/or Functional Variations for Makeup Shields

Any of the makeup shields described above may include one or more additional structural and/or functional variations, some exemplary embodiments of which are depicted in FIGS. 7-10. Additionally, or alternatively, it should be appreciated that any of the foregoing structural and/or functional aspects disclosed above with respect to FIGS. 1A-6B can be added to any of the forthcoming exemplary embodiments disclosed and/or represented in FIGS. 7-10. As a non-limiting example, the makeup shields disclosed in FIGS. 9 and 10 may include securing straps 112 for one or both of a user's ears.

Figure 7A:
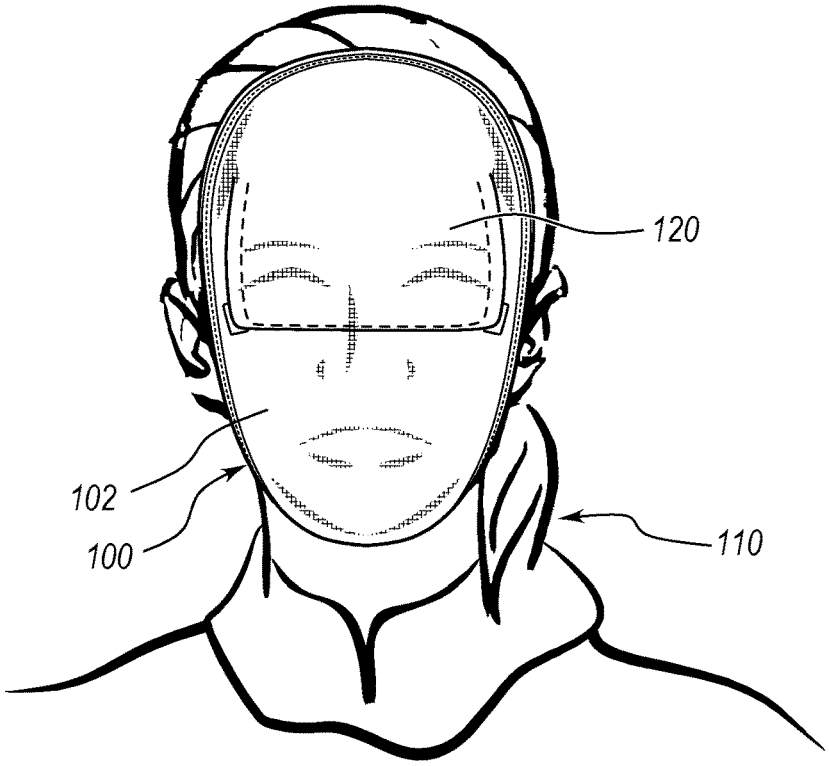
FIG. 7A illustrates an embodiment of a makeup shield having a selectively closable viewing flap in a closed configuration.
Figure 7B:
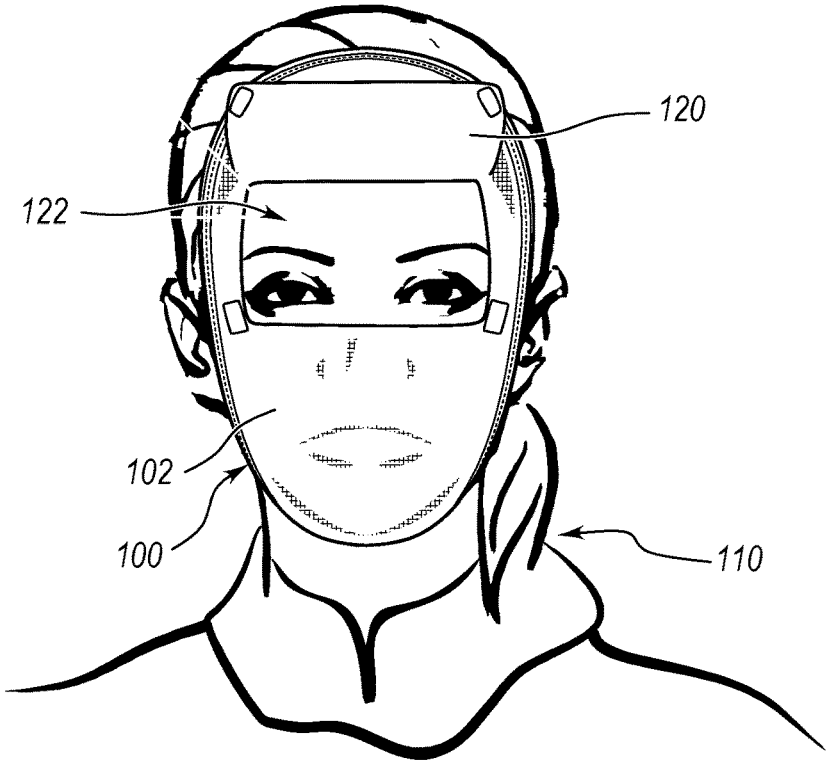
FIG. 7B illustrates an embodiment of a makeup shield having a selectively closable viewing flap in an open configuration.

In some embodiments, the nontransferable material may be transparent, translucent, or even opaque. Regardless of the degree of transparency offered by the nontransferable material, the user may wish to view themselves without any intervening material. In some embodiments, therefore, a makeup shield may include a viewing window. As illustrated in FIGS. 7A and 7B, the makeup shield 100 is associated with the face of a user 110, and a viewing flap 120 is selectively opened to reveal a viewing window 122. A bottom edge of the viewing flap 120 is shown as being selectively detachable by means of, for example, a hook and loop fastening system. The user 110 detaches the bottom edge of the viewing flap 120 and folds the viewing flap 120 towards the crown of a user's head, thereby transitioning the viewing flap 120 from a closed configuration to an open configuration to reveal viewing window 122. The viewing flap 120 may be reattached to cover the viewing window 122 to, again, return the viewing flap 120 to a closed configuration, thereby providing a barrier between the user's face and other external objects.

The viewing flap 120 is illustrated as being made of the same nontransferable material 102 as the rest of the makeup shield 100. In some embodiments, the viewing flap is made of a different nontransferable material than the rest of the makeup shield. It should be appreciated that although a hook and loop system is illustrated in FIGS. 7A and 7B, any mechanism for selectively detaching the viewing flap 120 to reveal the viewing window 122 is considered within the scope of this disclosure. For example, a button, zipper, snap, clip, adhesive patch, or other mechanism may be used. In one embodiment, there is no mechanism for selectively detaching the viewing flap. Instead, the viewing flap may be freely opened and closed without detaching or attaching any securing mechanism.

Figure 8A:
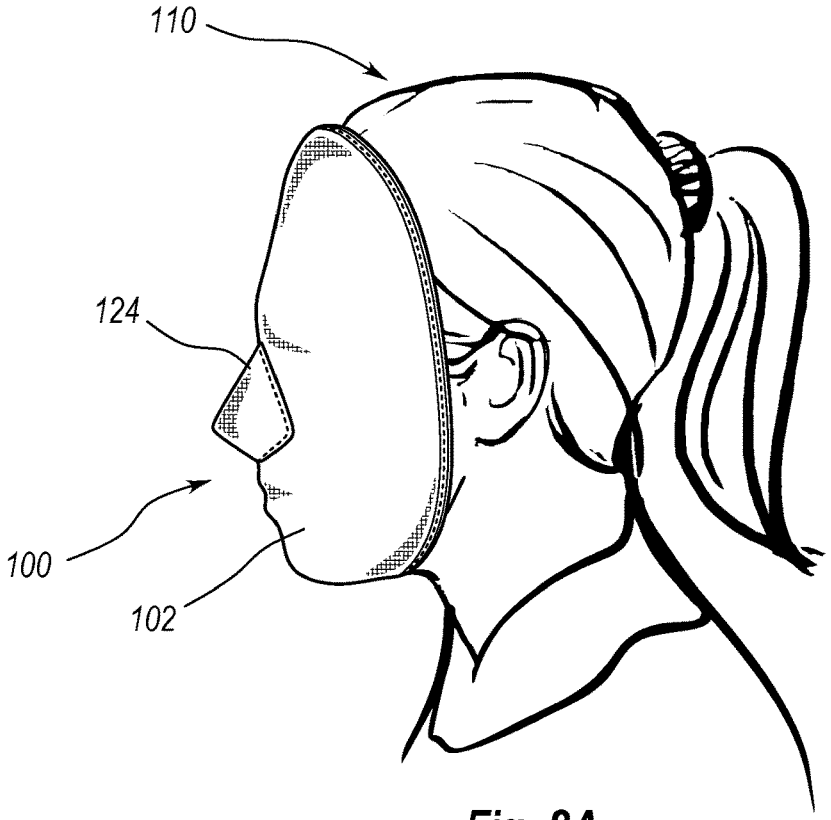
FIG. 8A illustrates a side profile view of an embodiment of a makeup shield that includes a nose pocket.
Figure 8B:
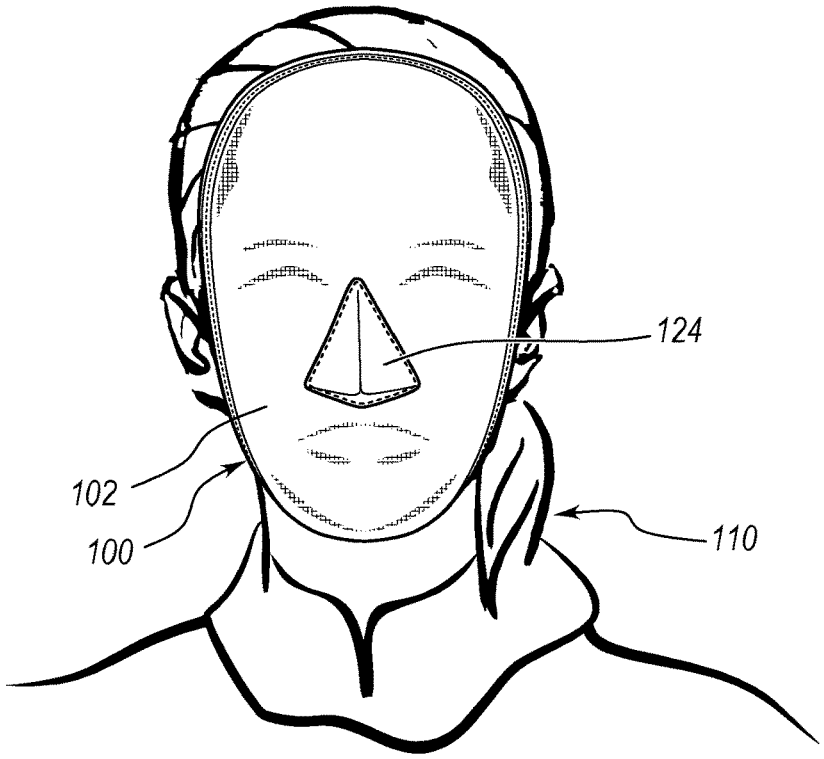
FIG. 8B illustrates a front portrait view of an embodiment of a makeup shield that includes a nose pocket.

Referring now to FIGS. 8A and 8B, a makeup shield 100 includes additional nontransferable material 124 at or near a center portion of the makeup shield 100. In some embodiments, the additional nontransferable material 124 is provided for the user's nose. The additional nontransferable material 124 may provide a pocket or bulge that accommodates the nose, as illustrated by the profile view of FIG. 8A. In some embodiments, the bottom edge of the additional nontransferable material is not connected to the remainder of the makeup shield so as to allow the defined breathing region within the makeup shield.

Figure 9A:
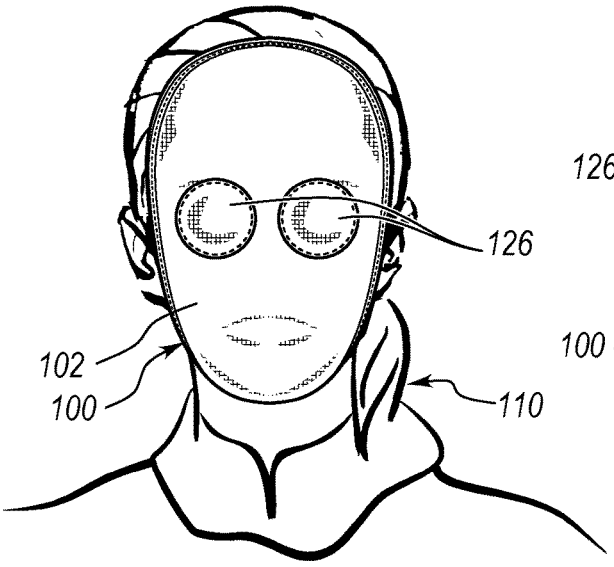
FIG. 9A illustrates a front portrait view of an embodiment of a makeup shield that includes a modified eye region.
Figure 9B:
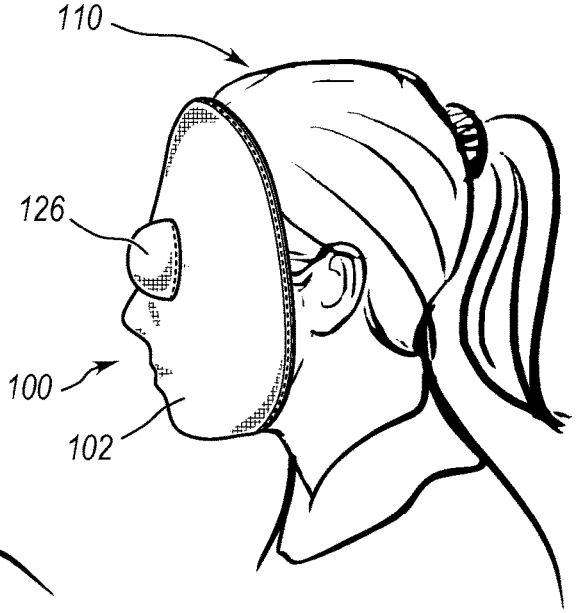
FIG. 9B illustrates a side profile view of an embodiment of a makeup shield that includes a modified eye region.

In some embodiments, additional nontransferable material 126 is provided at a position on the makeup shield corresponding to the user's eyes, as depicted in the portrait view and profile view of FIGS. 9A and 9B, respectively. The additional nontransferable material 126 illustrated in FIGS. 9A and 9B decreases the likelihood that long and/or cosmetically enhanced eyelashes will be disrupted or otherwise interfered with when donning the makeup shield. Although illustrated in FIG. 9A as including two separate, additional nontransferable material portions 126—one for each eye region—it should be appreciated that the additional nontransferable material 126 may be provided as a single portion covering both eye regions.

In some embodiments, the additional nontransferable material 124/126 includes less than 1 in.$^2$ of additional nontransferable material, less than 2 in.$^2$, less than 3 in.$^2$, less than 4 in.$^2$, less than 5 in.$^2$, less than 6 in.$^2$, less than 7 in.$^2$, less than 8 in.$^2$, less than 9 in.$^2$, or less than 10 in.$^2$ of additional nontransferable material. In some embodiments the additional nontransferable material 124/126 includes greater than 1 in.$^2$ of additional nontransferable material, greater than 2 in.$^2$, greater than 3 in.$^2$, greater than 4 in.$^2$, greater than 5 in.$^2$, greater than 6 in.$^2$, greater than 7 in.$^2$, greater than 8 in.$^2$, greater than 9 in.$^2$, or greater than 10 in.$^2$ of additional nontransferable material. In some embodiments, the amount of additional nontransferable material 124/126 is within a range defined by any of these foregoing upper and lower bounds.

Figure 9C:
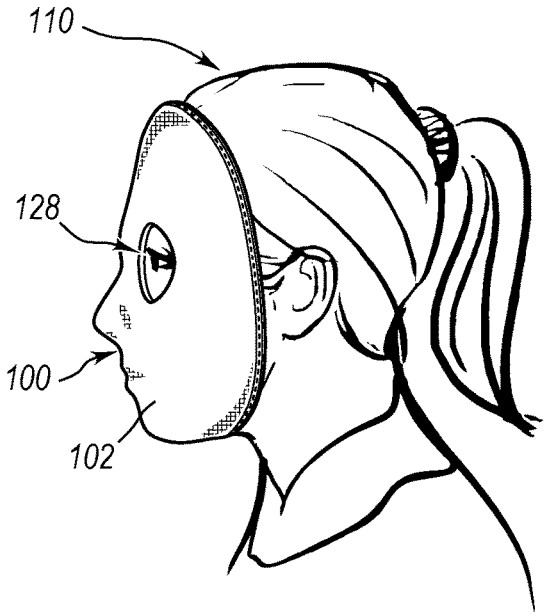
FIG. 9C illustrates a side profile view of another embodiment of a makeup shield that includes a modified eye region.

In one embodiment, and as depicted in FIG. 9C, the nontransferable material 102 of one or more eye regions 128 on the makeup shield 100 is removed, entirely exposing and/or not covering one or more eyes of the user 110. Although eye makeup may be disturbed in the absence of nontransferable material over the high region(s) 128, other regions of the user's face where makeup is applied remains protected. The makeup shield 100 depicted in FIG. 9C may additionally serve users who suffer from claustrophobia or other conditions where they dislike having material over their eyes.

Figure 9D:
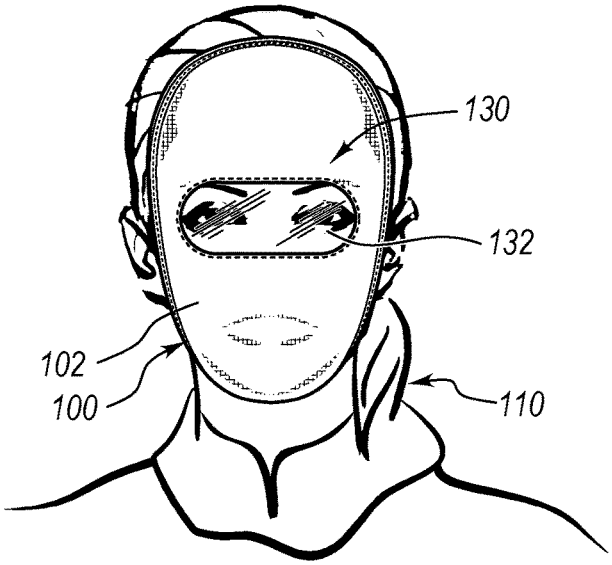
FIG. 9D illustrates a front portrait view of an embodiment of a makeup shield that includes a visor over the eye region.

Referring now to FIG. 9D, a makeup shield 100 may comprise two nontransferable materials 102, 132. A second nontransferable material 132 is illustrated as being more transparent/translucent than the nontransferable material 102 provided elsewhere on the makeup shield 100. The second nontransferable material 132 is provided in FIG. 3D as a visor 130 over the eye region of the user 110 such that the user 110 can see at least partially through the makeup shield, whereas the remainder of the makeup shield is made of the nontransferable material 102 that is at least not as transparent/translucent as the second nontransferable material 132 over the eyes. In such an embodiment, the makeup shield 100 maintains its ability to not transfer makeup and also allows the user to see more clearly through the makeup shield if, for example, the user 110 is implementing the makeup shield 100 in a dressing room or is otherwise placed in front of a mirror and desires to view themselves in the mirror without removing the makeup shield 100.

In some embodiments, the second nontransferable material includes any material—whether or not a nontransferable material—having a sheerness sufficient to at least partially see through when placed over the eyes. For example, the second (nontransferable) material can include a sheerness of less than 10 denier, less than 20 denier, less than 30 denier, less than 40 denier, less than 50 denier, less than 60 denier, greater than 1 denier, greater than 10 denier, greater than 20 denier, greater than 30 denier, greater than 40 denier, greater than 50 denier, greater than 60 denier, or any range created from the foregoing upper and lower bounds (e.g., between 1 denier and 40 denier).

In some embodiments, the nontransferable material is removed from both eyes in a single arcuate window, similar to the visor 130 shown in FIG. 9D but without the second nontransferable material 132 present.

Figure 10A:
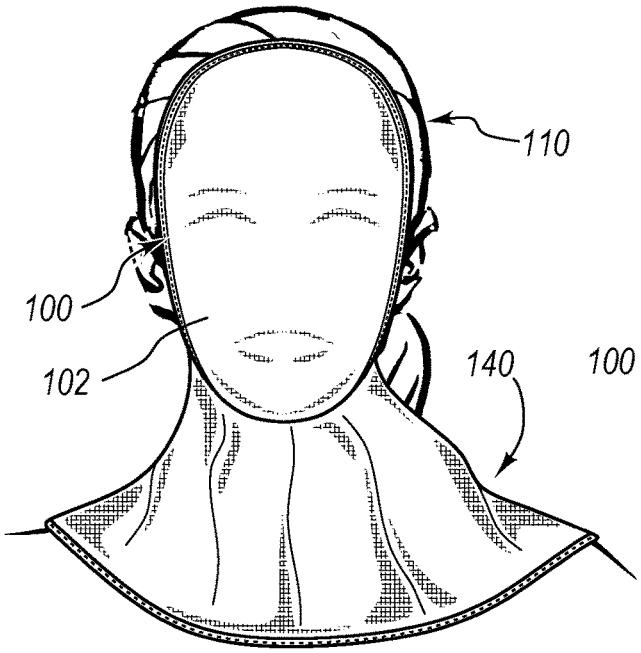
FIG. 10A illustrates a front portrait view of an embodiment of a makeup shield that includes a selectively detachable upper body guard.
Figure 10B:
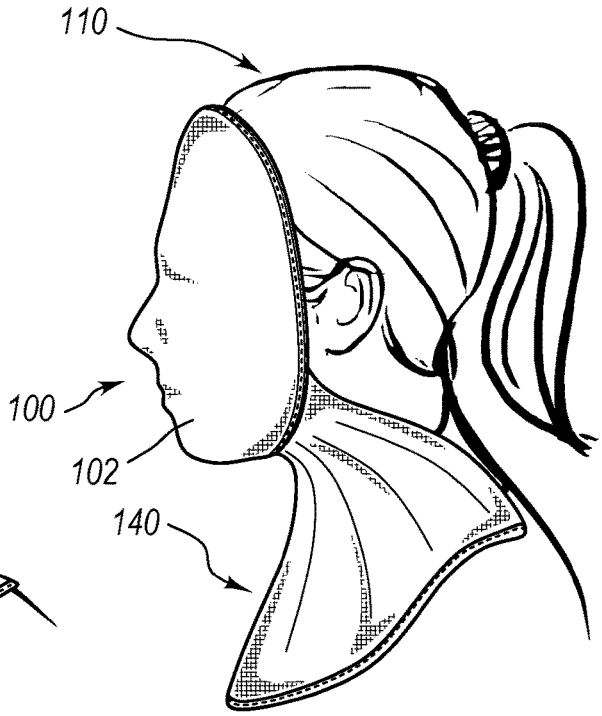
FIG. 10B illustrates a side profile view of an embodiment of a makeup shield that includes a selectively detachable upper body guard.
Figure 10C:
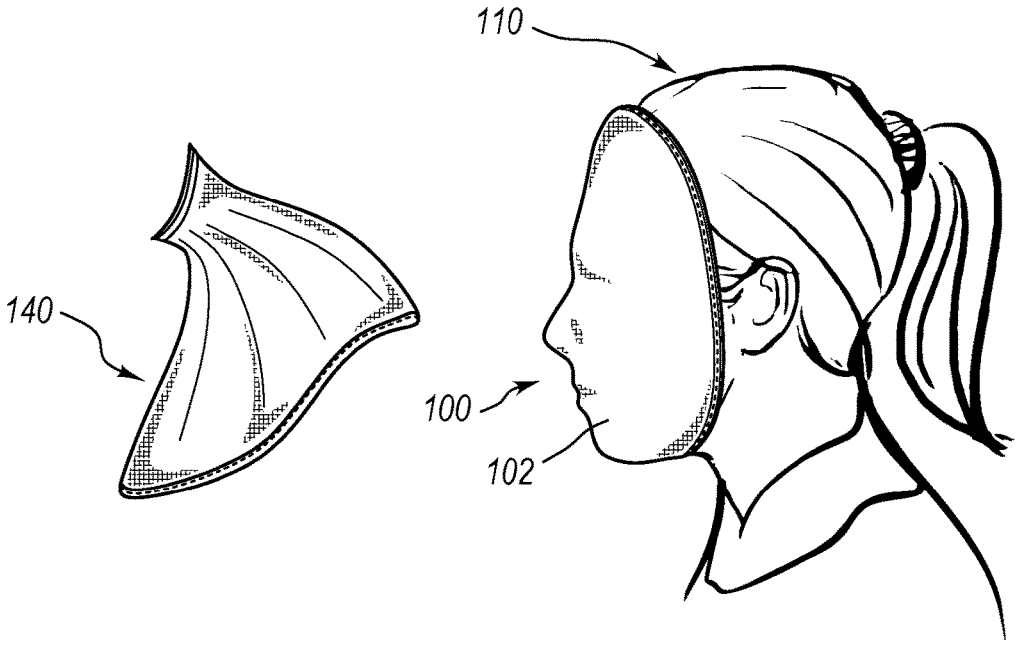
FIG. 10C illustrates the side profile view of the embodiment of a makeup shield that includes a selectively detachable upper body guard with the upper body guard illustrated as being selectively detached from the remaining makeup shield.

Referring now to FIGS. 10A-10C, the user 110 may apply makeup to their face, neck, and/or at least a portion of their chest. For example, users in a theatre group may don makeup on their chest and face and may undergo many costume changes in a given performance. To prevent makeup from transferring from the user 110 to clothing or other objects, the makeup shield 100 may be associated with a skirt 140. The skirt 140 is sized to cover one or more of the user's neck (or at least a portion of the user's chest), the user's shoulders, and/or the user's back. As illustrated in the front-facing view of FIG. 10A, the skirt 140 covers the neck of the user 110 and drapes at least partially down the user's chest and covers at least a portion of the user's shoulders.

In one embodiment, the skirt 140 is detachable from the makeup shield 100, as depicted in FIG. 10C. The skirt 140 is perforated along an edge proximate the chin region of the makeup shield 100, and may be torn away, leaving the makeup shield 100 associated with the user's face. In some embodiments, the skirt extends onto the back of the user, covering at least a back portion of the user's neck and/or at least an upper portion of the user's back. As mentioned above, some individuals apply makeup to their back, chest, and/or neck in addition to their face. By having the makeup shield associated with a detachable skirt, the user may selectively prevent interactions between portions of their body to which makeup has been applied and other objects, such as clothing.

Decorative Makeup Shields

Figure 11A:
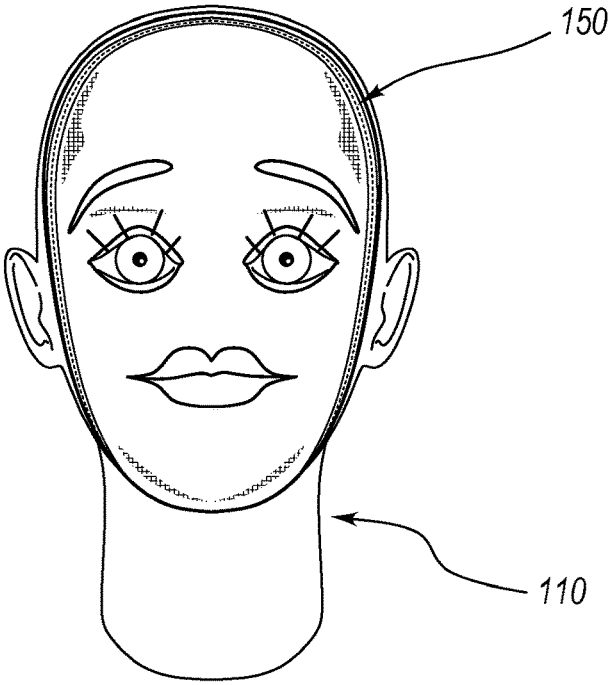
FIG. 11A illustrates an embodiment of a decorative makeup shield.
Figure 11B:
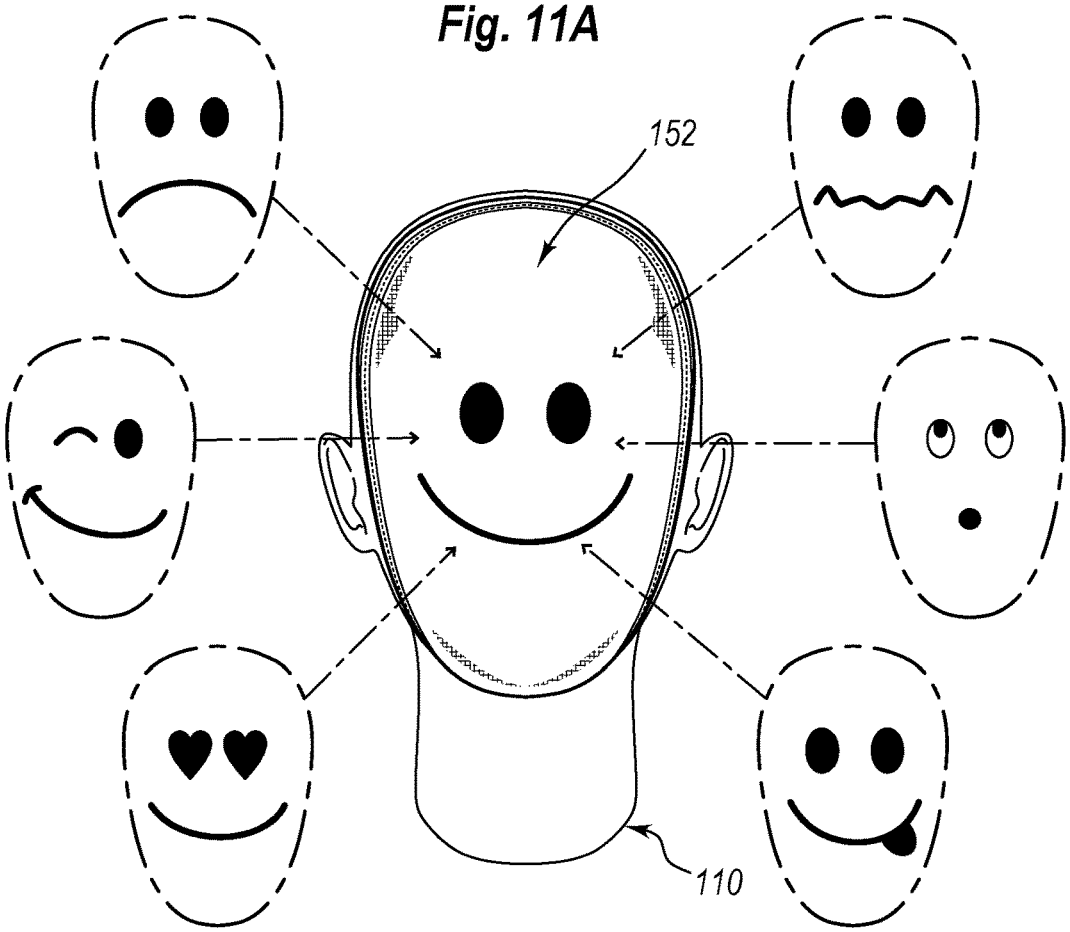
FIG. 11B illustrates various additional embodiments of decorative makeup shields.

Any of the makeup shields described above may include a decorative print or other embellishment, some exemplary embodiments of which are depicted in FIGS. 11A and 11B.

For example, a makeup shield 100, as described above, may include one or more facial features printed thereon. In one embodiment, the decorative facial feature(s) are applied to an outward facing surface of the makeup shield. This allows a user 110 additional context when viewing themselves in a reflective surface, such as a mirror. In some embodiments, the facial features are natural in appearance and may reflect any tonality, color, and/or definition of a human face. In some embodiments, the makeup shield is customized to the user's likeness. This may be accomplished through screen printing, super imposition of a photograph of the user's face onto the nontransferable material, or by any other means known in the art.

In some embodiments, the makeup shield is a decorative makeup shield 150 that includes a cartooned illustration. As illustrated in FIG. 11A, for example, the decorative makeup shield 150 can include cartooned eyes and mouth. As an additional example, the decorative makeup shield may include the likeness or caricature of a well-known cartoon character. For example, the decorative makeup shield may be printed with the likeness of Betty Boop. However, it should be appreciated that the decorative makeup shield may have any likeness, caricature, or image contained thereon such as a political figure, an actor, etc. and may also include animals, whether cartooned or lifelike.

Additionally, or alternatively, a characterized makeup shield 152 may include one or more emoji on an outward facing surface of the makeup shield, as illustrated in FIG. 11B. For example, the characterized makeup shield 152 may display a smiley face emoji.

In some embodiments, the likeness of the user 110, cartooned facial feature(s), caricature(s), characterized image(s) (e.g., an emoji), and/or other image(s) may be represented as a single instance on the makeup shield or may be present in multiple copies on the makeup shield and may be homogenously sized or of different sizes. As a non-limiting example, a characterized makeup shield 152 may include a single emoji centered on the makeup shield and roughly the proportion of the user's face. As an additional non-limiting example, the characterized makeup shield 152 may include a plurality of differently sized emoji, which may be the same emoji or different emoji.

In one embodiment, the decorative shields disclosed above may allow a user to outwardly identify how they feel about the clothing they are wearing, such as when trying on new clothes at a clothing retailer. For example, a user may don a decorative makeup shield with a smiley face emoji when they find an item that they like. As an additional example, a decorative makeup shield with a sobbing emoji and/or a poop emoji may be worn by a user who does not like the way the clothing looks or by a user who appreciates the way the clothing looks but saw that the associated price tag made the item unaffordable. The user is able to express their heartache through the emoji displayed on the decorative makeup shield and may walk out of a dressing room to an awaiting audience, such as friends or family, to quickly communicate how they feel without speaking—while also protecting the clothing and their makeup from being unintentionally spoiled by rubbing off on one another. Additionally, or alternatively, the user may snap a selfie of themselves in an outfit and decorative makeup shield and publish it to others to quickly express their feelings/thoughts, whether done through individual/group communications known in the art or through another medium such as a social networking site. In some embodiments, an array of decorative makeup shields are provided in a dressing room, allowing the user to switch and/or interchange decorative face shields before and/or after donning/doffing clothing.

In some embodiments, any of the makeup shields described above may additionally be associated with one or more scents. The scent is preferably a pleasant aroma, such as lavender, vanilla, peppermint, lemon, eucalyptus, bergamot, grapefruit, coconut, or any other scent. In a preferred embodiment, the scent is one or more of lavender or vanilla. In one embodiment, the scent is provided at a localized interior space which may be covered and/or sealed by an adhesive strip such that removal of the adhesive strip allows the scent to be released and smelled by the user. In the previous example, a makeup shield may be provided in an unscented state unless the adhesive strip is removed, whereby the makeup shield may be perceived as scented.

Unless defined otherwise, all technical and scientific terms used herein have the same meaning as commonly understood by one of ordinary skill in the art to which the present disclosure pertains.

Various aspects of the present disclosure, including devices, systems, and methods may be illustrated with reference to one or more embodiments or implementations, which are exemplary in nature. As used herein, the term "exemplary" means "serving as an example, instance, or illustration," and should not necessarily be construed as preferred or advantageous over other embodiments disclosed herein. In addition, reference to an "implementation" of the present disclosure or invention includes a specific reference to one or more embodiments thereof, and vice versa, and is intended to provide illustrative examples without limiting the scope of the invention, which is indicated by the appended claims rather than by the following description.

It will be noted that, as used in this specification and the appended claims, the singular forms "a," "an" and "the" include plural referents unless the context clearly dictates otherwise. Thus, for example, reference to a singular referent (e.g., "widget") includes one, two, or more referents. Similarly, reference to a plurality of referents should be interpreted as comprising a single referent and/or a plurality of referents unless the content and/or context clearly dictate otherwise. For example, reference to referents in the plural form (e.g., "widgets") does not necessarily require a plurality of such referents. Instead, it will be appreciated that independent of the inferred number of referents, one or more referents are contemplated herein unless stated otherwise.

As used herein, directional terms, such as "top," "bottom," "left," "right," "up," "down," "upper," "lower," "proximal," "distal," "adjacent" and the like are used herein solely to indicate relative directions and are not otherwise intended to limit the scope of the disclosure and/or claimed invention.

While the detailed description is separated into sections, the section headers and contents within each section are not intended to be self-contained descriptions and embodiments. Rather, the contents of each section within the detailed description are intended to be read and understood as a collective whole where elements of one section may pertain to and/or inform other sections. Accordingly, embodiments specifically disclosed within one section may also relate to and/or serve as additional and/or alternative embodiments in another section having the same and/or similar systems, modules, devices, methods, and/or terminology.

Various aspects of the present disclosure can be illustrated by describing components that are bound, coupled, attached, connected, and/or joined together. As used herein, the terms "bound," "coupled", "attached", "connected," and/or "joined" are used to indicate either a direct association between two components or, where appropriate, an indirect association with one another through intervening or intermediate components. In contrast, when a component is referred to as being "directly bound," "directly coupled", "directly attached", "directly connected," and/or "directly joined" to another component, no intervening elements are present or contemplated. Furthermore, binding, coupling, attaching, connecting, and/or joining can comprise mechanical and/or chemical association.

Various alterations and/or modifications of the inventive features illustrated herein, and additional applications of the principles illustrated herein, which would occur to one skilled in the relevant art and having possession of this disclosure, can be made to the illustrated embodiments without departing from the spirit and scope of the invention as defined by the claims, and are to be considered within the scope of this disclosure. Thus, while various aspects and embodiments have been disclosed herein, other aspects and embodiments are contemplated. While a number of methods and components similar or equivalent to those described herein can be used to practice embodiments of the present disclosure, only certain components and methods are described herein.

It will also be appreciated that systems, devices, products, kits, methods, and/or processes, according to certain embodiments of the present disclosure may include, incorporate, or otherwise comprise properties, features (e.g., components, members, elements, parts, and/or portions) described in other embodiments disclosed and/or described herein. Accordingly, the various features of certain embodiments can be compatible with, combined with, included in, and/or incorporated into other embodiments of the present disclosure. Thus, disclosure of certain features relative to a specific embodiment of the present disclosure should not be construed as limiting application or inclusion of said features to the specific embodiment. Rather, it will be appreciated that other embodiments can also include said features, members, elements, parts, and/or portions without necessarily departing from the scope of the present disclosure.

Moreover, unless a feature is described as requiring another feature in combination therewith, any feature herein may be combined with any other feature of a same or different embodiment disclosed herein. Furthermore, various well-known aspects of illustrative systems, methods, apparatus, and the like are not described herein in particular detail in order to avoid obscuring aspects of the example embodiments. Such aspects, however, are also contemplated herein.

The present disclosure may be embodied in other specific forms without departing from its spirit or essential characteristics. The described embodiments are to be considered in all respects only as illustrative and not restrictive. The scope of the invention, therefore, is indicated by the appended claims rather than by the foregoing description. While certain embodiments and details have been included herein and in the attached disclosure for purposes of illustrating embodiments of the present disclosure, it will be apparent to those skilled in the art that various changes in the methods, products, devices, and apparatus disclosed herein may be made without departing from the scope of the disclosure or of the invention, which is defined in the appended claims. All changes that come within the meaning and range of equivalency of the claims are to be embraced within their scope.

What is claimed is:

1. A makeup shield for preventing the transfer of makeup, comprising:

a face shield comprising a nontransferable material and defining an enclosure configured in size and shape to receive a face of a user;

an elastic band associated with a circumferential edge of the face shield and defining an elongate opening of the enclosure, the elastic band being configured to retain the nontransferable material of the face shield substantially between a face of a user and one or more objects; and a skirt detachably connected to the face shield along a perforation defining a boundary between the face shield and the skirt, wherein the skirt is comprised of the nontransferable material, wherein a first portion of the nontransferable material directly associated with a first length of the elastic band corresponds to a crown region and a second portion of the nontransferable material directly associated with a second length of the elastic band defining the boundary of the perforation corresponds to a chin region of the user such that the first length of the elongate elastic band associated with the crown region forms an elongate elastic crown band and the second length of the elongate elastic band associated with the chin region forms an elongate elastic chin band.

2. The makeup shield of claim 1, wherein the nontransferable material is greater than 40 denier and less than 70 denier to provide sheerness.

3. The makeup shield of claim 1, further comprising a visor, the visor being positioned on the makeup shield at an eye position and comprising a second material, wherein the second material is different from the nontransferable material.

4. The makeup shield of claim 1, further comprising an attachment mechanism comprising a securing strap associated with at least a second edge of the nontransferable material and configured to secure the makeup shield about an ear of the user.

5. The makeup shield of claim 4, wherein the nontransferable material is 100% polyester and is no more than 70 denier to provide sheerness.

6. The makeup shield of claim 1, further comprising a viewing flap and a viewing window, wherein the viewing flap is selectively opened to reveal the viewing window.

7. The makeup shield of claim 6, wherein a bottom edge of the viewing flap is selectively detachable from an opposing portion of the makeup shield by one or more of a hook and loop system, a button, a zipper, a snap, a clip, or combinations thereof.

8. The makeup shield of claim 1, wherein the nontransferable material is 100% polyester.

9. The makeup shield of claim 8, wherein the nontransferable material is no more than 70 denier to provide sheerness.

10. The makeup shield of claim 8, further comprising a visor, the visor being positioned on the makeup shield at an eye position and comprising a second nontransferable material being between 10-40 denier to provide sheerness.

11. The makeup shield of claim 1, wherein an outward facing surface of the nontransferable material comprises one or more of a cartooned illustration, a caricature, an emoji, or a likeness of the user.

12. The makeup shield of claim 11, wherein the outward facing surface comprises an emoji proportional in size to a face of the user.

13. The makeup shield of claim 1, comprising a scented material having a fragrance selected from the group consisting of: lavender, vanilla, peppermint, lemon, eucalyptus, bergamot, grapefruit, and coconut.

14. A makeup shield for preventing the transfer of makeup, comprising:

a face shield comprising a nontransferable material and defining an enclosure configured to associate with and be retained on a face of a user;

an elongate elastic band associated with a circumferential edge of the nontransferable material, wherein the elongate elastic band defines an elongate opening of the enclosure; and a skirt comprising the nontransferable material detachably connected by a line of perforations along at least a portion of the elongate elastic band, wherein the skirt is configured to associate with one or more of at least a portion of a neck, a chest, a back, or combinations thereof, wherein a first portion of the nontransferable material directly associated with a first length of the elastic band corresponds to a crown region and a second portion of the nontransferable material directly associated with the portion of the elongate elastic band connected to the line of perforations corresponds to a chin region of the user such that the first length of the elongate elastic band associated with the crown region forms an elongate elastic crown band and the second length of the elongate elastic band associated with the chin region forms an elongate elastic chin band.

* * * * *